US005424498A

United States Patent [19]

Spielbauer et al.

[11] Patent Number: 5,424,498

[45] Date of Patent: Jun. 13, 1995

[54] ELEVATOR START JERK REMOVAL

[75] Inventors: Hans-Kilian J. Spielbauer; Michael Peters, both of Berlin, Germany

[73] Assignee: Otis Elevator Company, Farmington, Conn.

[21] Appl. No.: 268,208

[22] Filed: Jun. 29, 1994

Related U.S. Application Data

[63] Continuation of Ser. No. 41,029, Mar. 31, 1993, abandoned.

[51] Int. Cl.[6] ..... B66B 1/44

[52] U.S. Cl. ..... 187/292; 187/393

[58] Field of Search ..... 187/100, 101, 118, 116, 187/115, 131

[56] References Cited

U.S. PATENT DOCUMENTS 3,847,251 11/1974 Maltby et al. ..... 187/115
4,337,848 7/1982 Kindler ..... 187/115
4,828,075 5/1989 Klingbeil et al. ..... 187/115
4,995,478 2/1991 Oshima et al. ..... 187/115
5,025,896 6/1991 Arabori et al. ..... 187/115
5,076,399 12/1991 Horbruegger et al. ..... 187/116

*Primary Examiner*—Steven L. Stephan
*Assistant Examiner*—Robert Nappi

[57] ABSTRACT

A constant bias velocity is dictated from a profile generator, while a torque value sent to an elevator drive is increased linearly until motion is detected. Then, the torque value is frozen. A normal velocity profile is started and coupled without discontinuity to the prior bias velocity dictation. In response to activation of an elevator loadweighing switch, an initial torque value is provided without boundary values stored in a table. Such static friction keeps an elevator car motionless when an elevator brake is lifted.

1 Claim, 4 Drawing Sheets

① LOAD IN CAR, MEASURED LOAD

② LOAD PERCENT INFORMATION SENT TO DBSS.

③ SLIDING FRICTION, DOWN DIRECTION.

④ STATIC FRICTION

⑤ SIDING FRICTION, UP DIRECTION.

Ⓐ START VALUE OF LOAD PERCENTAGE, HOLDS CAR IN STATIC FRICTION.

Ⓑ LOAD PERCENTAGE IS RAMPED UP DURING START IN UP DIRECTION.

Ⓒ TRANSITION FROM STATIC TO SLIDING FRICTION. CAR BEGINS TO MOVE.

① LOAD IN CAR, MEASURED LOAD

② LOAD PERCENT INFORMATION SENT TO DBSS.

③ SLIDING FRICTION, DOWN DIRECTION.

④ STATIC FRICTION

⑤ SIDING FRICTION, UP DIRECTION.

Ⓐ START VALUE OF LOAD PERCENTAGE, HOLDS CAR IN STATIC FRICTION.

Ⓑ LOAD PERCENTAGE IS RAMPED UP DURING START IN UP DIRECTION.

Ⓒ TRANSITION FROM STATIC TO SLIDING FRICTION. CAR BEGINS TO MOVE.

ELEVATOR START JERK REMOVAL

This is a continuation of application Ser. No. 08/041,029, filed Mar. 31, 1993, now abandoned.

TECHNICAL FIELD

The present invention relates to an elevator system in general, and in particular, to an elevator control device for smooth start-up.

BACKGROUND OF THE INVENTION

The start-up behavior of elevators is an essential criterion for the subjective judging of the feeling of the occupant, which in the start-up phase is determined basically by the acceleration, as well as by the acceleration changes and eventual vibrations. In this case, every acceleration of the elevator car and thus that of the passengers results from the superposition of the forces acting in the elevator system according to the formula Force equals Mass x Acceleration (F=MA). To be considered for the start-up in this connection are: A. the force of imbalance resulting from the difference between the car weight and the counterweight, B. the braking force of the blocking brake, C. the friction force resulting from the friction resistances of the movable parts, as well as D. the motor driving force resulting from the starting torque of the hoisting motor. As is generally known, there results during the start-up phase in some of these forces discontinuities in the derivative with respect to time. This relates A. to the braking force, because this force becomes suddenly zero on easing the mechanical blocking brake, as well as B. the friction resistances of all movable masses and the transmission components at standstill which are considerably greater than during movement and thus a very sudden change occurs on start-up from standstill. These mechanical discontinuities take place too rapidly to be controlled with the normal drive control. On the contrary, they cause control technological discontinuities and act according to the formula F=MA on the acceleration, which leads to strong changes in the acceleration, leading to jerks. Elevators of all types of construction tend to generate a start-up jerk when starting up from standstill.

In the past, a multitude of devices were proposed in order to eliminate this disagreeable start-up jerk completely or partially, and thereby to improve the comfort of travel. See, for example, German Publication No. 31 240 8. See also U.S. Pat. No. 4,828,075, "Elevator Drive Control Apparatus for Smooth Start-up;" and U.S. Pat. No. 5,076,399, "Elevator Start Control Technique for Reduced Start Jerk and Acceleration Overshoot," assigned to the same assignee as the present invention.

One cause for the start-up jerk is the unsteady derivative with respect to time of the friction during the transition from static friction to sliding friction as an elevator starts to move.

DISCLOSURE OF THE INVENTION

The object of the present invention is to eliminate the start jerk of an elevator car moving from standstill caused by the transition from static friction to sliding friction.

A further object is to find a starting torque value so that the elevator car is held by the static friction of mechanical elements of the elevator system and not by an elevator brake. This starting torque value is direction and load dependent. The optimal value can be achieved using analog load weighing equipment and a pre-torque value as a function of the load. Discrete load switches are a compromise to get a cost effective solution.

According to the present invention, a constant bias velocity is dictated from a profile generator, while a torque value sent to an elevator drive is increased linearly until motion is detected. Then, the torque value is frozen. A normal velocity profile is started and coupled without discontinuity to the prior bias velocity dictation. In further accord with the present invention, in response to activation of an elevator loadweighing switch, an initial torque value is provided in response to boundary values stored in a table. Such static friction keeps an elevator car motionless when an elevator brake is lifted.

BEST MODE FOR CARRYING OUT THE INVENTION

Figure 1:
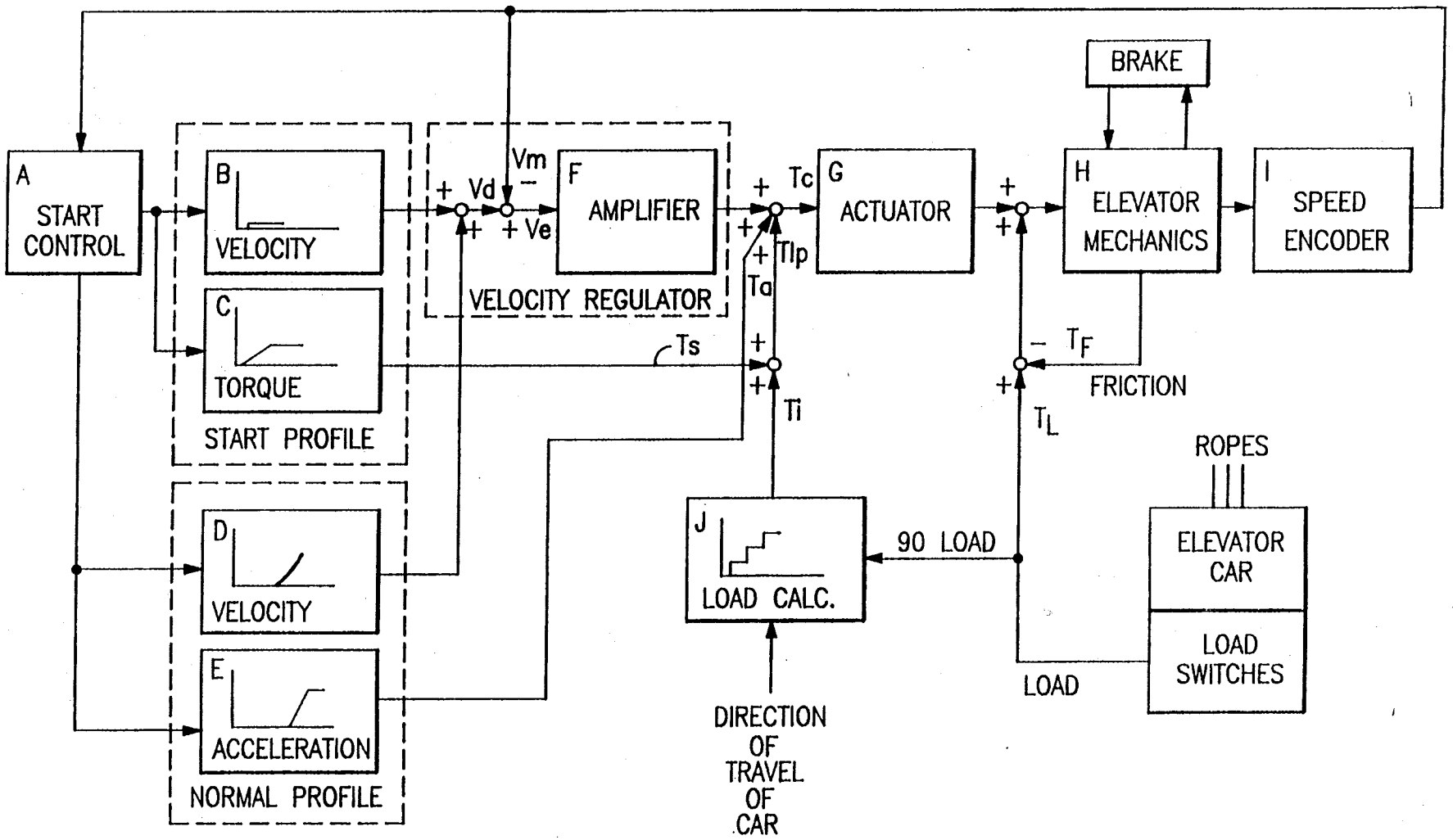
FIG. 1 is a block diagram of the present invention.

FIG. 1 is a block diagram of a closed loop velocity control scheme with discrete loadweighing switches according to the present invention. A start control, block A, handles selection of various profiles. After an elevator brake is opened, starting velocity and torque profiles are applied, from blocks B and C of the starting profile block. A measured velocity $V_m$ is used to indicate motion. Starting profiles are used before motion is detected during a starting phase. The normal profiles shown, blocks D and E, are used after motion is detected. A small bias constant velocity is given from block B to a summer of a velocity regulator during the starting phase. Also, in the starting phase, the starting torque is increased linearly with a fixed slope, block C, when the brake is lifted. Later when motion is detected, as indicated by measured velocity $V_m$, the starting torque $T_s$ is frozen. After motion is detected, the normal velocity profile is applied to the velocity regulator, block D. The amount of bias velocity, from block B, is taken into account for the calculation of the normal velocity profile. Simultaneously with the normal velocity profile, the normal acceleration profile is applied, block E. Block F is the amplifier module of the velocity regulator. The difference between the dictated velocity $V_d$ and the measured velocity $V_m$ is the input signal $V_e$. $V_d$ is the sum of the bias velocity and the velocity value calculated by the normal velocity profile generator. Due to the velocity error $V_e$, torque command $T_c$ (proportional to the armature current $I_{arm}$) is applied to minimize velocity regulation error. An actuator, block G, represents the power section of an elevator drive including a motor. The input signal to the actuator depends on the torque command $T_c$ generated by the velocity regulator, initial torque $T_i$ (J), starting torque $T_s$ (C), and an acceleration torque $T_a$ (E). The elevator mechanics, block H, are represented by the mechanical parts of the motor, gear, and hoistway. The input to block H is a specific amount of torque to achieve a defined movement of the car. A friction component of torque ($T_F$) must be handled, as well as the various load conditions and therefore load torque $T_L$. A speed encoder, block I, is mounted on a motor axis to measure the velocity $V_m$ of the elevator car. The load is measured by five load switches. Depending on the direction of travel and the load in the car, a discrete load value is transformed to a fixed initial torque value $T_i$, block J. This value is used for pretorquing while the brake is open and thus the car should not move in the presence of static friction (see A, FIG. 3). In other words, when each one of the five load switches is activated, a value for percent pretorque is computer generated (J), from a stored table of FIG. 3, which value is in the region 4 of FIG. 3.

Figure 2:
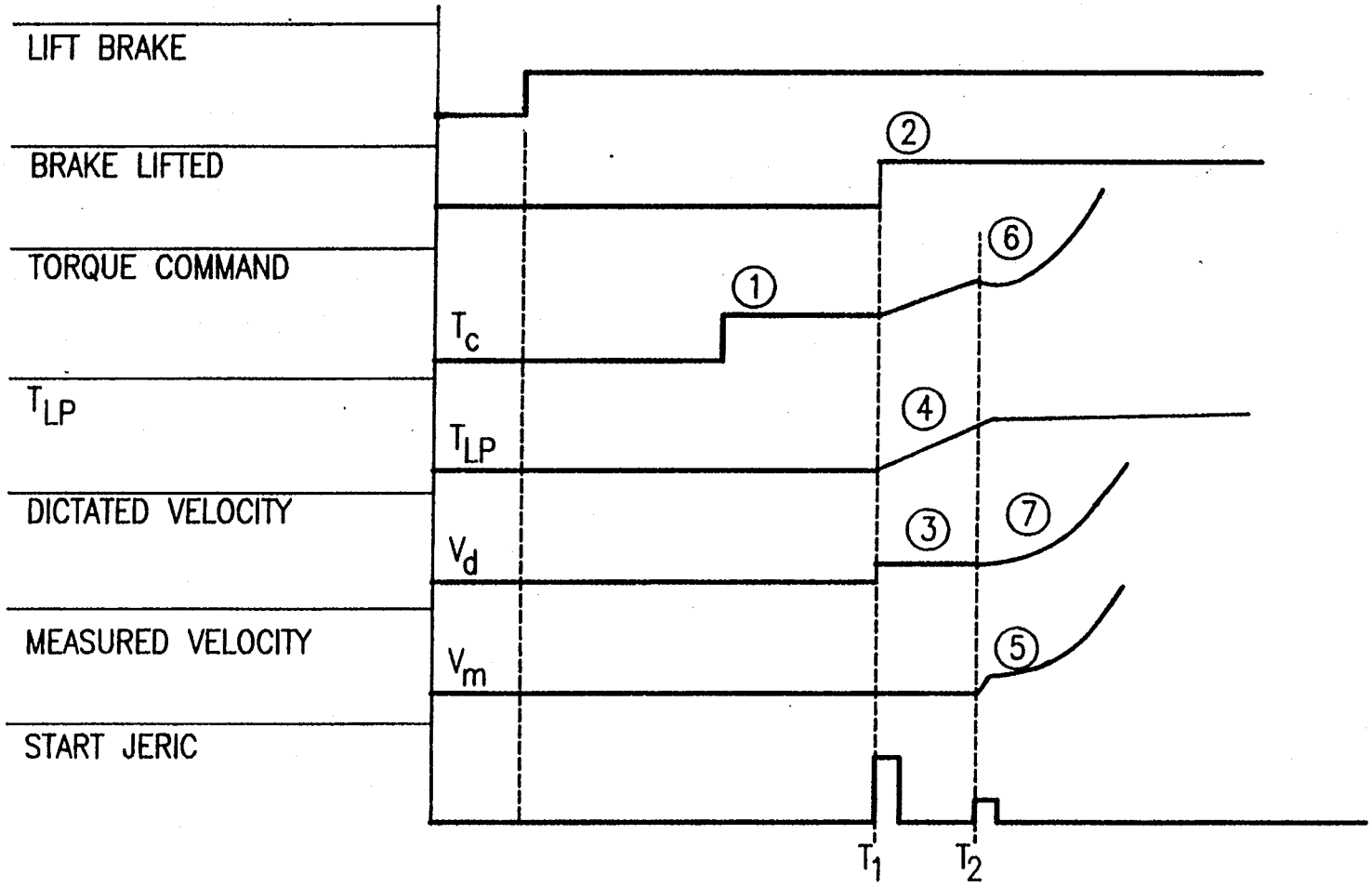
FIG. 2 is a diagram of signals illustrated in FIG. 1 on a common time line.

FIG. 2 is a timing diagram showing various signals of the block diagram of FIG. 1 on a common time line. In FIG. 2, (1)-(7) illustrate timing of certain events. At (1), after the brake is commanded to lift, the torque command $T_c$ to the motor is applied to hold the car in the static friction (see A, FIG. 3). The amount of torque $T_c$ (as a function of $T_i$) is based on the load percent, % LOAD, (see B, FIG. 3). The torque $T_c$ should be sufficient to hold the elevator car still when the brake is lifted. At (2), the brake lifts, and this is reported to the start control, block A (FIG. 1). At (3), the constant bias velocity is dictated (start control block A, FIG. 1). At (4), $T_s$ and therefore $T_{LP}$ increase until the torque command $T_c$ has reached an amount where the transition from static friction to sliding friction occurs. At (5), the friction force changes from static to sliding friction (see C, FIG. 3). The elevator car starts to move as indicated by the measured velocity $V_m$. At (6), the torque command $T_c$ is reduced to lessen the friction when the car is moving because while the elevator car is moving the required torque $T_c$ is not the same as before motion, and therefore the torque $T_c$ dips. At (7), the normal velocity profile and normal acceleration profile are dictated. The normal velocity profile is coupled linearly to the bias velocity. Without the invention, a large start jerk occurs at $T_1$, whereas this is eliminated when the invention is used and a smaller start jerk occurs later at $T_2$.

Figure 3:
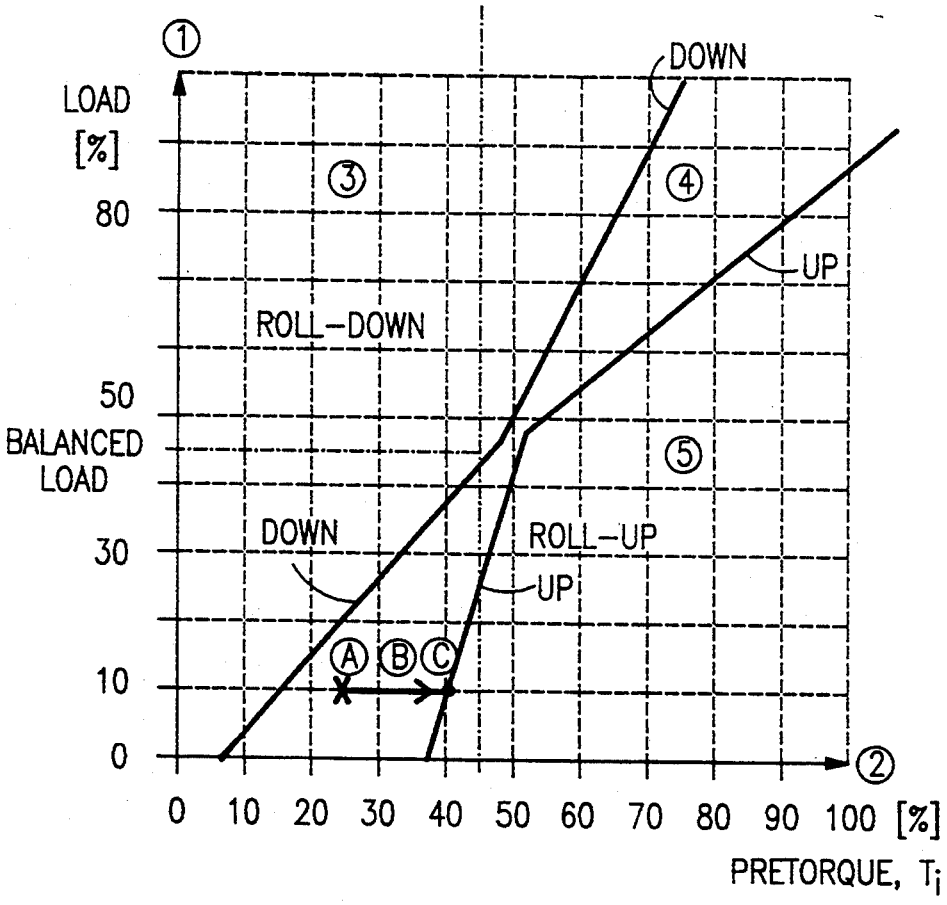
FIG. 3 is a graph, % LOAD v. % PRETORQUE, $T_i$.

FIG. 3 is a graph of % LOAD v. % PRETORQUE to the actuator (Block G, FIG. 1). For a given number of load switches activated, a given pretorque is dictated. The initial value of this pretorque $T_i$ is such as to keep the graph operating point of the control system in FIG. 1 of % LOAD v. % PRETORQUE in the static friction region 4, such as at point A. The piecewise linear plots on the left and right side of the graph of FIG. 3 are boundaries. Outside of these boundaries, in regions 3 or 5, a given % LOAD at a given % PRETORQUE, $T_i$ is associated with sliding in the down or up direction. The piece-wise linear plot on the left is associated with an elevator car moving in the down direction. The piecewise linear plot on the right is associated with an elevator car moving in the up direction.

Figure 4:
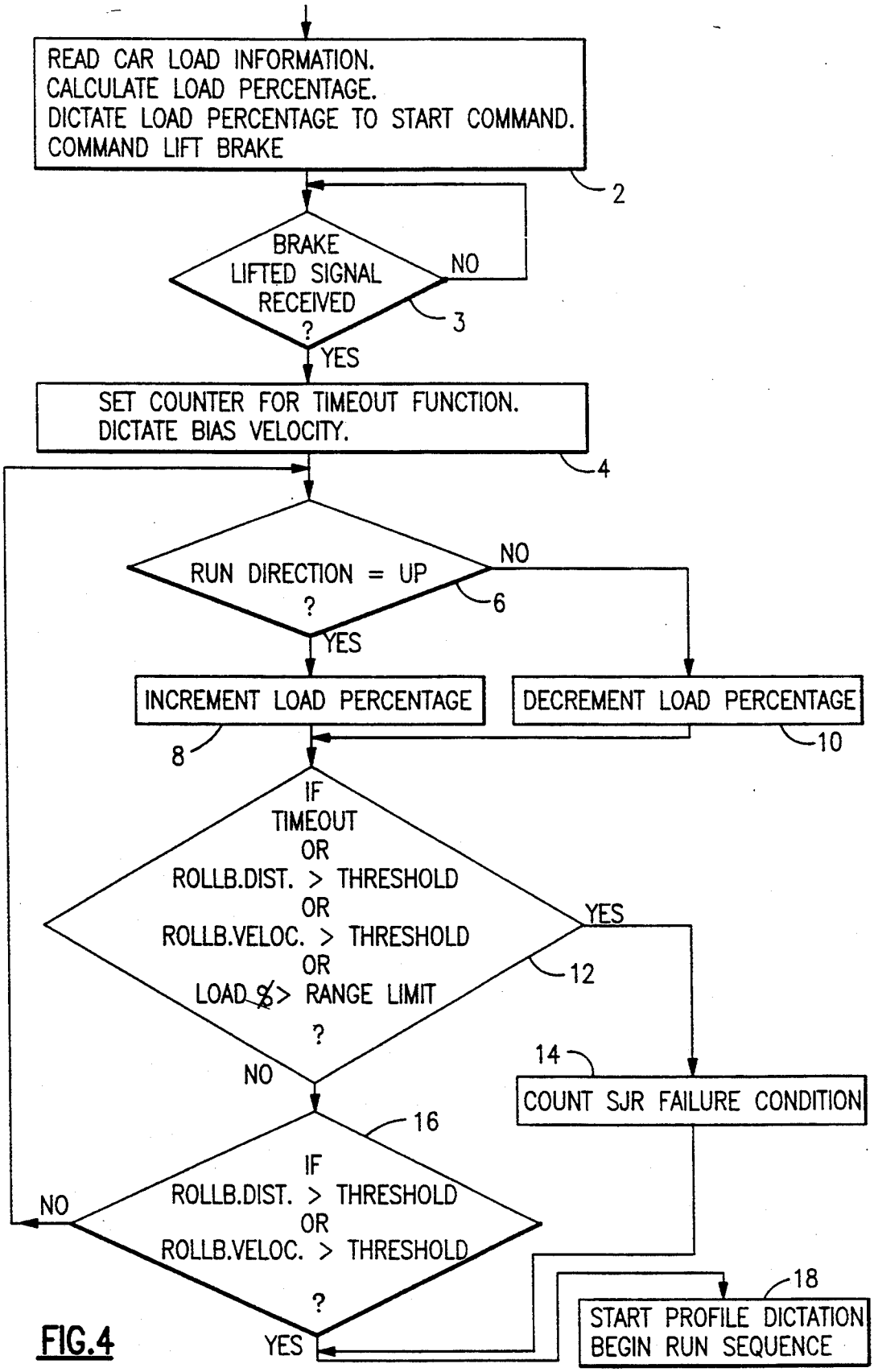
FIG. 4 is a logic chart.

FIG. 4 shows a flow chart that includes the invention. After a run is made, the number of load switches activated is read, a %LOAD is calculated and provided to the START control, and the brake is commanded to lift, step 2. When the brake has lifted, a counter is set and the bias velocity dictated, steps 3 and 4. The count in the counter represents a time equal to a $T_{LP}$ ramping delay from the time the brake is commanded to lift to the time when the $T_{LP}$ and therefore $T_c$ ramps up to $T_1$ of FIG. 2 plus the time for the ramping of $T_c$ to take place. This time is TIMEOUT. % LOAD is decremented or incremented depending on whether the elevator car is running up or down, steps 6, 8, 10. If (i) TIMEOUT has expired, this means that (ii) the elevator car has rolled back farther than a threshold, (iii) rolled back faster than a threshold velocity, or (iv) the percentage load to the start control has exceeded a range. A start jerk rejection failure counter is then incremented, steps 12 and 14. If the conditions immediately above are not met, and if the elevator car has not rolled forward beyond a threshold or rolled forward faster than a threshold velocity, steps 6–16 are repeated. Otherwise, the elevator car runs according to a normal profile sequence, 18.

Various modifications here do not affect the spirit or scope of the invention.

We claim:

1. A method for starting movement of an elevator car, the motion of which is caused by an actuator including a brake which is released in response to a brake lift signal, comprising:

providing a load signal indicative of the load in the car;

providing a direction signal indicative of the travel direction assigned to the car;

providing a brake lift command signal to cause said brake to release;

after and in response to said brake lift command signal but before the brake releases, providing to said actuator an initial torque command in response to said load signal and said direction signal of a magnitude to hold said car motionless in the presence of static friction when said brake is released;

in response to said brake being released, providing a torque command to said actuator as the summation of said initial torque command, a velocity torque command indicative of a low, creep velocity, and a starting torque command which increases with time until motion of said car is detected after which said starting torque command is held constant; and in response to detecting motion of said car, providing a torque command to said actuator as the summation of said initial torque command, said constant starting torque command, and a velocity torque command indicative of said low, creep velocity summed with a normal velocity profile.

* * * * *